US005085066A

United States Patent [19]

Komami et al.

[11] Patent Number: 5,085,066

[45] Date of Patent: Feb. 4, 1992

[54] METHOD FOR SUPPRESSING FLUCTATION OF WIDTH IN HOT ROLLED STRIP

[75] Inventors: Yuji Komami; Megumi Kan; Toshiyuki Tamai; Ttaru Hishinuma, all of Chiba, Japan

[73] Assignee: Kawasaki Steel Corporation, Hyogo, Japan

[21] Appl. No.: 593,336

[22] Filed: Oct. 1, 1990

Related U.S. Application Data

[63] Continuation of Ser. No. 415,410, Sep. 29, 1989, abandoned, which is a continuation of Ser. No. 159,723, Feb. 24, 1988, abandoned.

[30] Foreign Application Priority Data

Feb. 24, 1987 [JP] Japan ..... 62-40629

[51] Int. Cl.[5] ..... B21B 37/10; B21B 45/02

[52] U.S. Cl. ..... 72/13; 72/201

[58] Field of Search ..... 72/13, 200, 201, 202; 148/12 R, 12 B, 128, 156; 266/113

[56] References Cited

U.S. PATENT DOCUMENTS

| | | | |
|---|---|---|---|
| 3,364,713 | 1/1968 | Fukuda et al. | 72/201 |
| 3,533,261 | 10/1970 | Hollander et al. | 72/201 |
| 4,596,615 | 6/1986 | Matsuzaki et al. | 72/201 X |

FOREIGN PATENT DOCUMENTS

| | | | |
|---|---|---|---|
| 49-23751 | 3/1974 | Japan . | |
| 56-56705 | 5/1981 | Japan . | |
| 58-199613 | 11/1983 | Japan | 72/201 |
| 59-10418 | 1/1984 | Japan . | |
| 59-83721 | 5/1984 | Japan | 72/201 |
| 598672 | 3/1978 | U.S.S.R. | 72/201 |
| 1235579 | 6/1986 | U.S.S.R. | 72/201 |

OTHER PUBLICATIONS

Soviet Inventions Illustrated, week 8702, 14th Jan. 1987, class M21, Abstract No. 87-013977/02, Derwent Publications, Ltd., London, Great Britain.

Patent Abstracts of Japan, vol. 12, No. 139 (C-491) 4th Oct. 1983; JP-A-58 119 411.

Patent Abstracts of Japan, vol. 12, No. 139 (C-491), 27th Apr. 1988 JP-A-62 256 920.

Iron and Steel Engineer, vol. 53, No. 10, Oct. 1976; pp. 29-34 E. N. Hinrichsen, "Hot Strip Mill Runout Table Cooling-A System of Control, Operation and Equipment".

*Primary Examiner*—E. Michael Combs

*Attorney, Agent, or Firm*—Austin R. Miller

[57] ABSTRACT

A method and system for suppressing necking and hunting of a hot rolled strip in a hot rolling line includes holding of the strip temperature at the outlet of a finishing mill at a temperature immediately above a transformation temperature. Air cooling of the strip is performed from the transformation start point to the transformation end point. The transformation end point, rapid cooling by water cooling is performed thereafter.

7 Claims, 3 Drawing Sheets

METHOD FOR SUPPRESSING FLUCTATION OF WIDTH IN HOT ROLLED STRIP

This application is a continuation of application Ser. No. 415,410, filed Sep. 29, 1989, now abandoned, which is a continuation of application Ser. No. 159,723, filed Feb. 24, 1988, now abandoned.

BACKGROUND OF THE INVENTION

1. Field of the Invention

The present invention relates generally to a method and system for suppressing fluctuation of width in a hot rolled strip or sheet metal, in a hot mill line. More specifically, the invention relates to a technique for cooling hot rolled strip or sheet metal transferred from a finishing mill to a coiler and suppressing fluctuation of width.

2. Description of the Background Art

In general, hot rolled strip is transferred from a finishing mill to a coiler in a hot mill line. When the leading edge of the hot rolled strip reaches the coiler and is coiled by the coiler, an impulsive tension force may be exerted on the strip. This impulsive tension force is transmitted throughout the hot rolled strip between the finishing mill and the coiler. As is well known, such impulsive tension force may particularly apply to the portion of the strip at a position downstream of the finishing mill, up to several tens of meters to serve as a force causing longitudinal expansion. Consequently, necking may occur at the portion where the impulsive tension force is applied to reduce the width of the strip.

Namely, in the conventional hot mill line, the hot rolled strip from the finishing mill is transferred through a run-out table and cooling stage where a cooling device discharging cooling water toward the hot rolled strip is provided, to the coiler. A pair of pinch rollers are provided in the vicinity of the coiler for assisting coiling. In the usual layout of the hot mill line, the finishing mill and the coiler are distanced at about 150 meters. Along the path of the hot rolled strip between the finishing mill and the coiler, a thickness gauge, a shape monitor, a width gauge, a thermometer and so forth are arranged. These strip condition monitoring facilities are generally provided in the vicinity of the outlet of the finishing mill. In order to allow arrangement of these strip condition monitoring facilities, a distance of about 10 meters has to be provided between the finishing mill to the inlet of the cooling stage. Therefore, the hot rolled strip from the finishing mill has to be transferred in an uncooled condition for about 10 meters.

On the other hand, in order to hold the coiling performance and configuration of the end of the coil in good condition, the coiler should be driven at a leading speed which is 1.1 to 1.3 times higher than the line speed of the strip. Due to this difference of the speed between the coiler and the strip, an impulsive tension force may be generated at the beginning of coiling. This impulsive tension force causes local necking particularly at portions of the strip where deformation resistance is small. In our experience, it has been appreciated that the impulsive tension force particularly locally affects the configuration of the strip at the portion about 20 meters from the finishing mill to cause local necking.

Once the leading end of the strip is coiled by the coiler, the coiler speed becomes synchronous with the line speed of the strip. At the portion of the strip following the portion where necking is observed, hunting in width to fluctuate the width of the strip occurs. Such hunting in width is considered to be caused by temperature differences influenced by skid marks at the outlet of the finishing mill and/or by the relationship between the hot strength of the strip and the unit tension.

In order to suppress necking and hunting as set forth above, the Japanese Patent First (unexamined) Publication (Tokkai) Showa 59-10418 discloses a system including a looper or pinch rollers vertically movable between the finishing mill and the coiler. The looper and pinch roller are responsive to the tension force to be exerted on the hot rolled strip for providing an extra length of strip in order to absorb the extra tension force and regulate the tension force to be exerted on the strip.

On the other hand, the Japanese Patent First Publication (Tokkai) Showa 56-56705 discloses a method for absorbing the impulsive tension force by means of pinch rollers. In the disclosure, the pinch rollers pinch the hot rolled strip, hold the strip until the coiler speed becomes synchronous with the line speed, and release the pinching force after the tension is substantially regulated.

Furthermore, the Japanese Patent First Publication (Tokkai) Showa 49-23751 proposes to provide a greater width for the portion of the hot rolled strip where necking possibly occurs. The extra width to be provided for the possible portion to cause necking, will be determined at a value corresponding to reduction of the magnitude of the width due to necking. In the alternative, the Japanese Patent First Publication Showa 49-23751 also proposes a technique able to perform rapid cooling for the strip so as to provide sufficient deformation resistance to the strip for preventing the strip from causing deformation including necking.

In the Japanese Patent First Publication 59-10418, since the extra length of the strip is provided through the looper or pinch rollers, tension force at the initial stage becomes insufficient to hold the coiled leading end portion of the strip in good configuration. Especially, when waving is caused in the strip, the length of the strip to be provided by the looper or pinch roller becomes too great to make it possible to establish the metal strip coil in the desired coil configuration. On the other hand, in case of the Japanese Patent First Publication 56-56705, the pinch rollers should be provided a pinching force substantially corresponding to the possible impulsive tension force. Therefore, relatively bulky construction of the pinch roller is required, increasing the facility cost. Furthermore, in order to drive such bulky construction of the pinch rollers, relatively large electric power would be consumed. In addition, in case of thin strip which tends to cause waving an extra length of the strip may be provided between the pinch rollers and the coiler to reduce the tension force to be exerted on the strip therebetween. In the worst case, the substantial waving of the strip may provide an extra length of the strip to lose tension to be exerted on the strip. Therefore, similarly to the technique of the Japanese Patent First Publication 59-10418, the tension force becomes insufficient to hold a good coil configuration. In such case, in order to make the coil configuration in good shape, the mandrel of the coiler has to be accelerated again after the pinch rollers are released. By accelerating the mandrel, impulsive tension force may be exerted on the strip to cause necking and/or hunting.

In case of the Japanese Patent First Publication 49-23751, in order to satisfactorily and completely compensate the reduction of the strip width in necking, it is necessary to provide the extra width in the portion of 50 meters in length which corresponds to 7 to 8 meters of the sheet bar. On the other hand, the longitudinal region to cause necking is about 20 meters. Therefore, the extra width of the strip may be lend in a as length of 30 meters. When the coil with the extra width portion is processed in the cold mill line for example, edge folding may occur at the portion where the extra width is maintained when an edge portion control is performed. In order to avoid the possibility of edge folding, a slow-down line speed in the cold mill line becomes necessary.

Consequently, the conventionally proposed systems are not satisfactory in suppressing necking and/or hunting of the strip width, at all.

SUMMARY OF THE INVENTION

Therefore, it is an object of the present invention to provide a method and system for satisfactorily suppressing necking and hunting in the strip.

Basically, it is found that necking and hunting will occur at the portion of a strip where hot strength is small. In occurrence of necking, reduction of the width of the strip width occurs through the portion where the hot strength is small. Therefore, when the region of the portion of the strip where the hot strength is small is limited, reduction of width due to expansion of the strip length is distributed through a limited region. As a result, magnitude of reduction at the region becomes substantial. In other words, when the region where the hot strength is small extends a relatively long range, the reduction is distributed through a relatively long range to make the magnitude of reduction of the width in each section smaller.

Based on the idea set forth above, the present invention includes holding of the strip temperature at the outlet of a finishing mill at a temperature immediately above a transformation temperature. Air cooling of the strip is performed from the transformation start point to the transformation end point. Rapid cooling by water cooling is performed thereafter.

According to one aspect of the invention, a method for suppressing fluctuation of width of a hot rolled strip transferred through a path extending from a finishing mill to a coiler in a hot rolling line comprises the steps of:

maintaining the temperature of the hot rolled strip at an outlet of a finishing roll at a temperature slightly above the $Ar_3$ transformation temperature;

performing air cooling of the hot rolled strip while it travels through the path, until the temperature of the hot rolled strip drops below a designated transformation end point; and discharging liquid state cooling medium on the hot rolled strip after the temperature of the hot rolled strip drops below the tranformation end point.

According to another aspect of the invention, coiling a hot rolled strip in a hot rolling line comprises the steps of:

providing a plurality of nozzles for discharging liquid state cooling medium along and in alignment with the path;

connecting the nozzles to a cooling medium source via flow control valves;

maintaining the temperature of the hot rolled strip at an outlet of a finishing roll at a temperature slightly above the $Ar_3$ transformation temperature of the strip;

setting material data including the $Ar_3$ transformation point;

deriving the $Ar_3$ transformation end point, and whereby determining a switching position in the path and at said position terminating air cooling and starting cooling with liquid state cooling medium, said switching position being determined on the basis of the transformation end point;

transferring the hot rolled strip through a path extending between the finishing mill to the coiler; and controlling the flow control valves in such a manner that the flow control valves associated with nozzles oriented upstream of the transformation end point are shut-off and the flow control valves associated with nozzles oriented downstream of the transformation end point are open.

In a method and process set forth above, it is preferred to include a further step of deriving orientation of the switching position as a distance La from the outlet of the finishing mill. In the practical process, the switching point La is determined by the equation:

$$La = \{(\theta_F - \theta_T) \times \gamma \times \beta \times T + H_T \times \gamma \times T\}/(\alpha_A \times \theta_T) \times 6 \times 10^{-2} \times V \quad (1)$$

where $\theta_F$ is the temperature of the hot rolled strip at the outlet of the finishing mill (°C.);

$\theta_T$ is the temperature at the transformation end point of the strip (°C.);

$\gamma$ is the density of the steel ($Kg/m^3$);

$\beta$ is the relative temperature (kcal/kg °C.);

T is the thickness of the strip (mm);

$H_T$ is the latent heat of transformer (kcal/kg);

$\alpha_A$ is the heat transfer coefficient in air cooling ($Kcal/m^2$ hr °C.); and V is the line speed of the strip (m/min).

In the alternative, the switching point can be detected by means of least one sensor for monitoring the state of the rolled strip and detecting the hot transformation end point for switching the cooling mode from air cooling to cooling by the liquid state cooling medium.

According to a further aspect of the invention, the system for suppressing fluctuation of width of a hot rolled strip transferred through a path extending from a finishing mill to a coiler in a hot rolling line comprises means for maintaining the temperature of the hot rolled strip at an outlet of a finishing roll at a temperature slightly above the $Ar_3$ transformation temperature of the strip, means for performing air cooling of the hot rolled strip while it travels through the path, until the temperature of the hot rolled strip drops below said transformation end point, and means for discharging liquid state cooling medium on the strip after the temperature of the hot rolled strip drops below said transformation end point.

According to a still further aspect of the invention, a system of coiling a hot rolled strip in a hot rolling line comprises a plurality of nozzles for discharging the liquid state cooling medium along the path and in alignment therewith, a passage means connecting the nozzles to a cooling medium source, a plurality of flow control valves disposed within the passage means and respectively associated with corresponding nozzles, each of the flow control valves being operable between a shut-off position wherein communication between the associated nozzle and the cooling medium source is blocked and an open position wherein such communication is established, means for maintaining the temperature of the hot rolled strip at an outlet of a finishing roll at a temperature slightly above the $Ar_3$ transformation temperature, means for establishing material data for the strip including the $Ar_3$ transformation point, means for deriving the transformation end point, and thereby determining a switching position in the path at which to terminate air cooling and to start cooling with the liquid state cooling medium on the basis of the transformation end point, means for transferring the hot rolled strip through a path extending between the finishing mill to the coiler, and a controller controlling the flow control valves in such a manner that the flow control valves associated with the nozzles oriented upstream of the transformation end point of the strip are shut-off and the flow control valves associated with nozzles oriented downstream of the transformation end point of the strip are open.

BRIEF DESCRIPTION OF THE DRAWINGS

The present invention will be understood more fully from the detailed description given herebelow and from the accompanying drawings of the preferred embodiment of the invention, which, however, should not be taken to limit the invention to the specific embodiment but are for explanation and understanding only.

In the drawings.

DESCRIPTION OF THE PREFERRED EMBODIMENT

Figure 1:
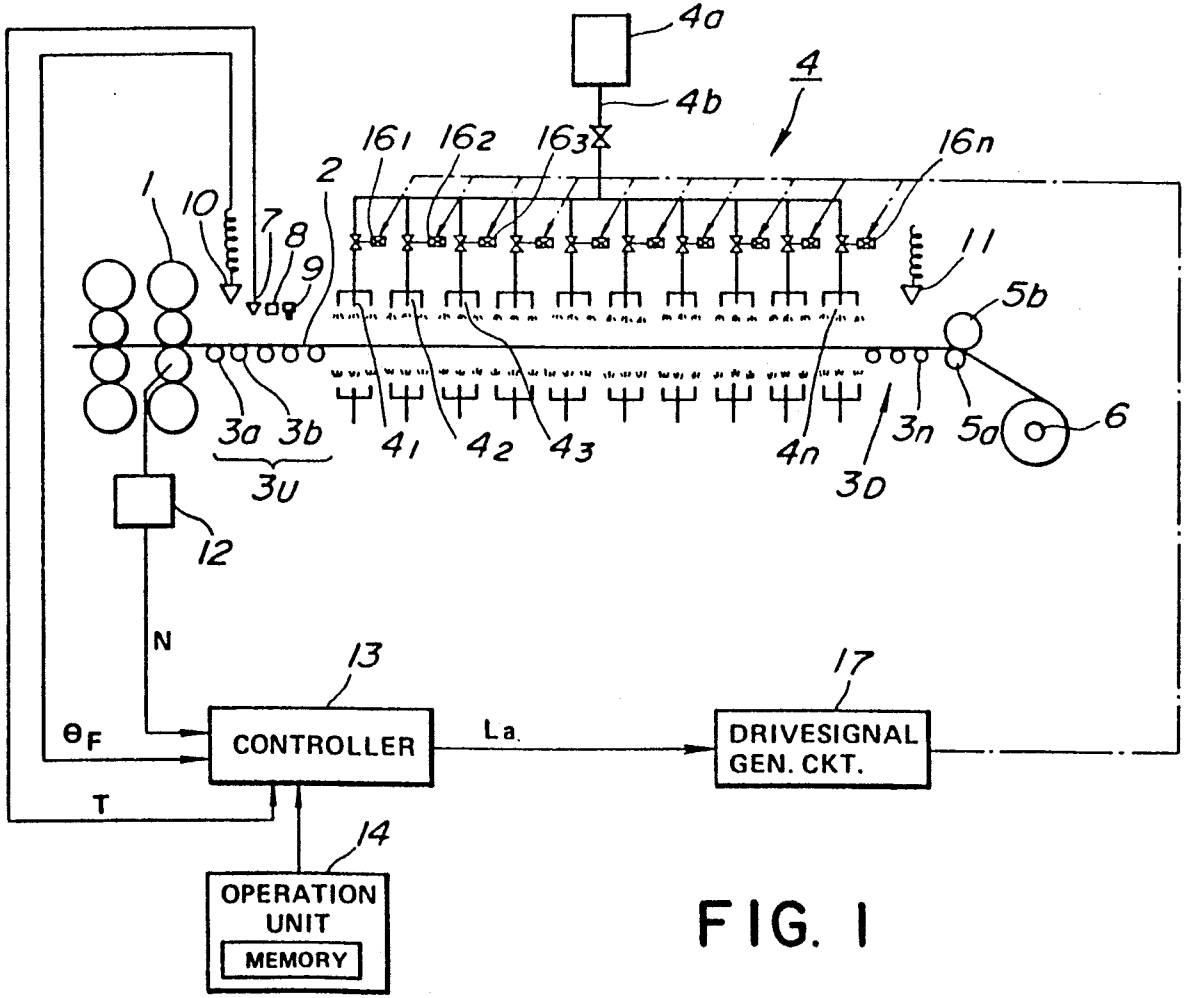
FIG. 1 is a fragmentary illustration of the preferred embodiment of a section in a hot mill line transferring hot rolled strip from a finishing mill to a coiler.

Referring now to the drawings, particularly to FIG. 1, the preferred embodiment of a hot mill line for implementing suppression of fluctuation of width of hot rolled strip 2, according to the present invention, is particularly directed to a transfer section for transferring the hot rolled strip 2 from a finishing mill 1 to coiler 6. The transfer section includes an upstream side run-out table $3_U$, a cooling device 4, a downstream side run-out table $3_D$ and a pair of pinch rollers 5*a* and 5*b*. The hot rolled strip 2 is transferred through the transfer section.

A plurality of transfer rollers 3*a*, 3*b* . . . 3*n* are provided between the upstream and downstream run-out tables $3_U$ and $3_D$. An X-ray thickness gauge 7, a shape monitor 8, strip width gauge 9 and a thermometer 10 are provided along the upstream run-out table $3_U$. On the other hand, a thermometer 11 is provided along the downstream run-out table $3_D$.

In the preferred hot rolling process, the temperature $\theta_F$ at the outlet of the finishing mill 1 is adjusted slightly above the transformation temperature $Ar_3$ of the strip. Therefore, transformation of the hot rolled strip occurs in the vicinity of the outlet of the finishing mill 1.

If the transformation start point is set at the position between stands of the mills in the hot mill line, material strength upon transformation rapidly drops. Therefore, the tension force to be exerted on the strip between the mill stands becomes excessive to cause ruptures and generate semi-finished products. At the same time, rolling in the $\gamma+\alpha$ dual phase region may cause substantial variation of the strip deformation resistance, i.e. material strength which may result in fluctuation of the thickness of the strip. On the other hand, if the transformation start point is set at a position close to the coiler, it becomes difficult to control cooling performance in relation to a desired coiling temperature. Furthermore, in order to set the transformation start point near the coiler, the temperature of the strip has to be maintained above the transformation temperature through a relatively long transferring range. This naturally requires a high heating temperature and a high fuel consumption rate. Therefore, the preferred position of the transformation start point is in the vicinity of the outlet of the finishing mill.

The shown embodiment of the system thus controls the temperature of the strip at the outlet of the finishing mill at a temperature slightly above the transformation temperature so that the transformation start point is located in the vicinity of the outlet of the finishing mill. For controlling the strip temperature at the outlet of the finishing mill, a controller 13 is provided in the system. The controller 13 is connected to the thermometer 10 and the thickness gauge 7 to receive therefrom strip temperature indicative data $\theta_F$ and thickness indicative data T and other gauges to receive various control parameters therefrom. The controller 13 is also connected to an operation unit 14 including a memory 15 containing data such as transformation end temperature $\theta_T$ (°C.), transformation latent heat $H_T$ (kcal/kg), heat transfer coefficient $\alpha_A$ (kcal/m$^2$ hr °C.) and so forth. These data, e.g. $Ar_3$ transformation temperature $\theta_T$, transformation caloric value $H_T$, heat transmission rate $\alpha_A$ and so forth are set in the memory 15 in relation to the kind of strip or sheet metal to be produced. The controller 13 is further connected to a detector 12 for monitoring the rotation speed of the rolls. The detector 12 produces roller rotation speed indicative data and feeds the same to the controller 13. The controller 13 processes the roller rotation speed indicative data to derive the line speed V (m/min) in terms of the diameter of the roll.

On the other hand, the controller 13 further controls the cooling device in order to perform air cooling of the strip for a predetermined distance from the transformation start point. The distance between the outlet of the finishing mill and the transformation end point will be hereafter referred to the "air cooling range". The controller 13 derives the length La of the air cooling range on the basis of the transformation end temperature $\theta_T$ and other input data. An arithmetic operation is performed by the controller 13 utilizing the following equation (1):

$$La=[(\theta_F-\theta_T)\times\gamma\times\beta\times T+H_T\times\gamma\times T]/(\alpha_A\times\theta_T)\times 6\times 10^{-2}\times V \quad (1)$$

where $\theta_F$ is the temperature of the hot rolled strip at the outlet of the finishing mill (°C.);

$\theta_T$ is the temperature at the transformation end point of the strip (°C.);

$\gamma$ is the density of steel (Kg/m$^3$);

$\beta$ is the relative temperature (kcal/kg °C.);

T is the thickness of the strip (mm);

$H_T$ is the latent heat of transformation (kcal/kg);

$\alpha_A$ is the heat transfer coefficient in air cooling (Kcal/m$^2$ hr °C.); and V is the line speed of the strip (m/min).

The cooling device 4 comprises a plurality of cooling water discharge nozzles $4_1$, $4_2$, $4_3$ . . . $4_n$. These nozzles $4_1$, $4_2$, $4_3$ . . . $4_n$ are aligned along the path of the hot rolled strip provided for transferring the strip from the finishing mill 1 to the coiler 6. Each of the discharge nozzles $4_1$, $4_2$, $4_3$ . . . $4_n$ is connected to a cooling water source 4a via cooling water delivery piping 4b. Electromagnetic valves $16_1$, $16_2$, $16_3$ . . . $16_n$ are associated with respective discharge nozzles 41, 42, 43 . . . 4n for establishing and blocking connection between the cooling water source 4a and the discharge nozzle. The electromagnetic valves $16_1$, $16_2$, $16_3$ . . . $16_n$ are, on the other hand, connected to a drive signal generator circuit 17 to be controlled between an open position establishing connection between the cooling water source and the valve and a closed position blocking the connection. In order to control the valve positions of the electromagnetic valves $16_1$, $16_2$, $16_3$ . . . $16_n$, the drive signal generator circuit 17 generates drive signals and selectively feeds the drive signals to the electromagnetic valves.

Namely, based on the length of the optimum air cooling range as derived through the arithmetic operation utilizing the aforementioned equation (1), the controller 13 causes the electromagnetic valves to be placed at closed positions and at open positions to selectively control the drive signals so that only electromagnetic valves to be operated to the open positions may be driven by the drive signals. By selectively feeding the drive signals to the electromagnetic valves, some of the electromagnetic valves located at the upstream side are held in closed position so as to block the cooling water. Therefore, the hot rolled strip is cooled by exposing it to the air so as to maintain the temperature of the strip within a transformation range from the transformation start point to the transformation end point.

Figures 2A, 2B:
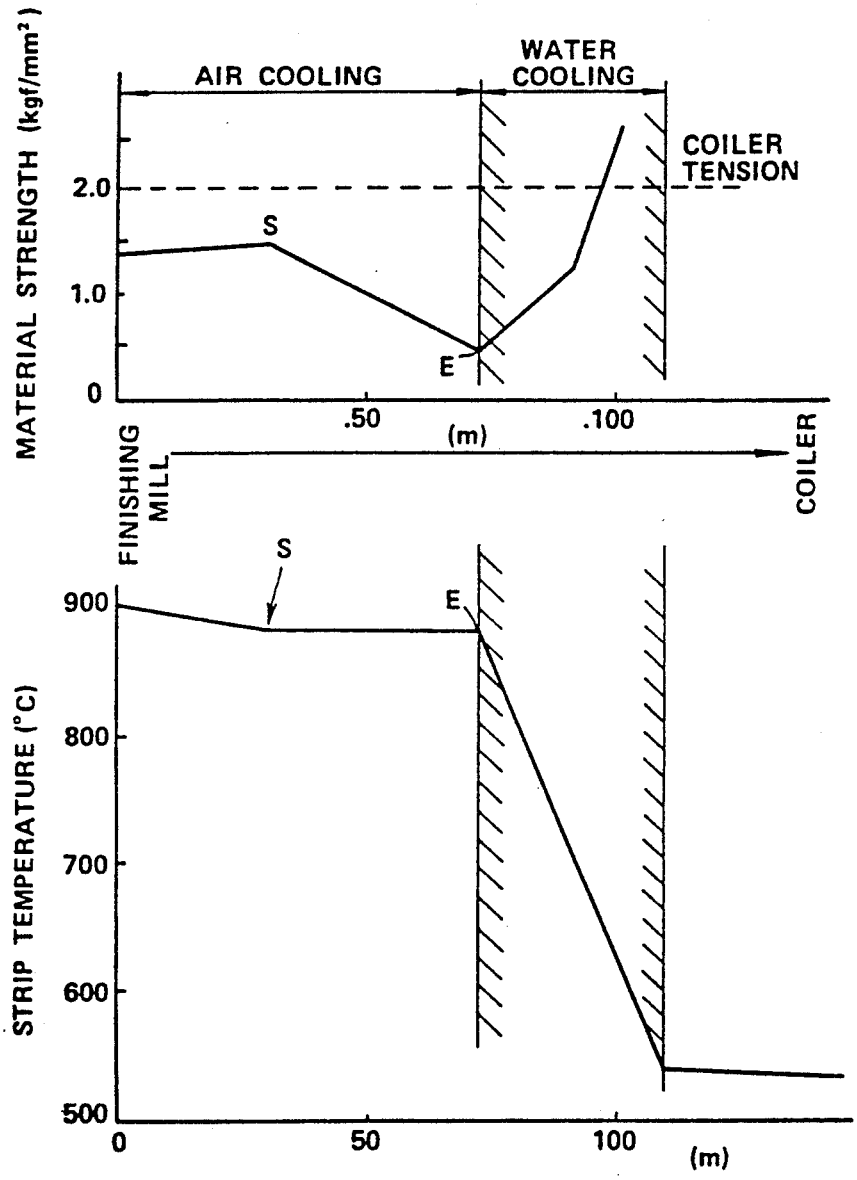
FIG. 2(*a*) and 2(*b*) are charts showing material strength and strip temperature in relation to the distance of the strip from the finishing mill.
Figure 3A:
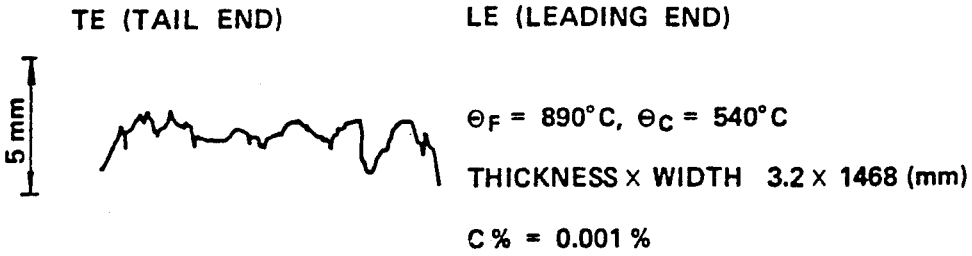
FIG. 3(*a*) and 3(*b*) are charts showing variations of the strip width in the invention and in the prior art.
Figure 3B:
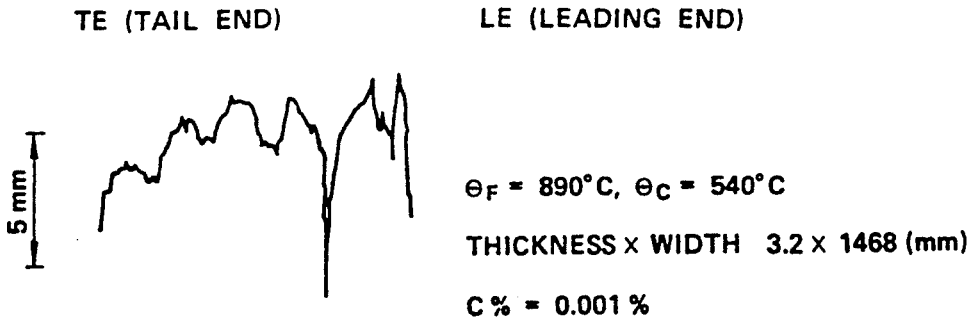

FIGS. 2(*a*) and 2(*b*) shows variations of the material strength and strip temperature at various positions along the path of the hot rolled strip between the finishing mill and the coiler as cooled in the preferred process. As will be seen from FIGS. 2(*a*) and 2(*b*), the hot rolled strip transferred from the outlet of the finishing mill is at first cooled by air cooling up to the transformation end point E which is determined by the length La of the air cooling range in relation to the transformation start point S.

As will be appreciated, by air cooling, drop of temperature of the hot rolled strip becomes rather slow to elongate the transformation range. Therefore, when an impulsive tension force is exerted on the strip to cause stretchins in the longitudinal direction, reduction of the width of the strip may be distributed over a relatively elongated range, i.e. throughout the transformation range, to make the reduction magnitude at each section of the strip small. Furthermore, by moderately air cooling the strip, rapid change of material strength can be suppressed to successfully prevent the strip from experiencins necking and hunting in width.

In order to confirm the effect of the preferred process and system according to the invention, experiments were performed. Following are discussions of the experiments performed with regard to the preferred embodiments of the process and system for cooling the hot rolled strip.

EXAMPLE 1

In the first experiment, hot rolling was performed for extra low carbon steel of 0.001C%. The temperature of the hot rolled strip at the outlet of the finishing mill was 890° C. On the other hand, the temperature of strip at the coiler was 540° C. The slab was hot rolled to obtain strip of 3.2 mm thick and 1468 mm width. The air cooling range La was set at a length of 75 m. After the transformation end point, water cooling was performed for rapid cooling.

In order to compare with the foregoing inventive process, a comparative experiment was performed utilizing the same material and setting of the temperature at the outlet of the finishing mill and at the coiler. In the comparative experiment, air cooling was performed in a first 10 m and subsequently water cooling was performed. The results of the invention and the comparative example are shown in the appended table 1. As will be seen from the table 1, by the invention, the magnitude of necking was reduced to about ⅓ of the comparative example. Similarly, by the invention, the magnitude of hunting was reduced to about 1/5 of the comparative example.

EXAMPLE 2

In the second experiment, hot rolling was performed for extra low carbon steel of 0.001C %. The temperature of the hot rolled strip at the outlet of the finishing mill was 890° C. On the other hand, the temperature of strip at the coiler was 700° C. The slab bar was hot rolled to obtain a strip 3.5 mm thick and of 1524 mm width. The air cooling range La was set at a length of 94 m. After the transformation end point, water cooling was performed for rapid cooling.

Similarly to the foregoing first experiment, a comparative experiment was performed utilizing the same material and setting of the temperature at the outlet of the finishing mill and at the coiler. In the comparative experiment, air cooling was performed in a first 10 m and subsequently water cooling was performed. The results of the invention and comparative example are shown in the appended table 2. From table 2, substantial improvement in magnitude of necking and hunting was obtained.

EXAMPLE 3

In the third experiment, hot rolling was performed for low carbon steel of 0.04C %. The temperature of the hot rolled strip at the outlet of the finishing mill was 820° C. On the other hand, the temperature of strip at the coiler was 540° C. The slab was hot rolled to obtain a strip 1.6 mm thick and of 928 mm width. The air cooling range La was set at a length of 46 m. After the transformation end point, water cooling was performed for rapid cooling.

Similarly to the foregoing first and second experiments, a comparative experiment was performed utilizing the same material and setting of the temperature at the outlet of the finishing mill and at the coiler. In the comparative experiment, air cooling was performed in a first 10 m and subsequently water cooling was performed. The results of the invention and comparative example are shown in the appended table 3. From the table 3, substantial improvement in magnitude of necking and hunting was obtained. As will be seen from table 3, by the invention, the magnitude of necking was reduced to about ⅓ of the comparative example. Similarly, by the invention, the magnitude of hunting was reduced to about ½ of the comparative example.

EXAMPLE 4

In the fourth experiment, hot rolling was performed for carbon steel of 0.36C %. The temperature of the hot rolled strip at the outlet of the finishing mill was 790° C. On the other hand, the temperature of strip at the coiler was 540° C. The slab bar was hot rolled to obtain a strip 1.6 mm thick and of 918 mm width. The air cooling range La was set at a length of 46 m. After the transformation end point, water cooling was performed for rapid cooling.

Similarly to the foregoing first and second experiments, a comparative experiment was performed utilizing the same material and setting of the temperature at the outlet of the finishing mill and at the coiler. In the comparative experiment, air cooling was performed in a first 10 m and subsequently water cooling was performed. The results of the invention and comparative example are shown in the appended table 4. From the table 4, not so substantial improvement in magnitude of necking and hunting was observed. This occurred since the material strength drop in the transformation range in the carbon steel was not so substantial as that in the extra low carbon steel or low carbon steel.

From these experiments set forth above, it was confirmed that the preferred process is particularly effective in the hot rolling of extra low carbon steel and low carbon steel.

It should be appreciated that through the shown embodiment arithmetically derives the transformation end point, it may be possible to employ a transformation ratio sensor in the path to detect the transformation end point for controlling the cooling device. Furthermore, though the shown embodiment uses water as a medium for rapid cooling of the strip, the cooling medium for rapid cooling is not limited to water but can be replaced by any appropriate coolant.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

TABLE 1

| | La (m) | Number of Strip Rolled | Magnitude of Necking (mm) | Magnitude of Hunting (mm) |
|---|---|---|---|---|
| Invention | 75 | 10 | 2.1 | 0.4 |
| Comparative | 10 | 10 | 6.3 | 1.9 |

TABLE 2

| | La (m) | Number of Strip Rolled | Magnitude of Necking (mm) | Magnitude of Hunting (mm) |
|---|---|---|---|---|
| Invention | 94 | 20 | 1.1 | 0.2 |
| Comparative | 10 | 20 | 3.8 | 4.6 |

TABLE 3

| | La (m) | Number of Strip Rolled | Magnitude of Necking (mm) | Magnitude of Hunting (mm) |
|---|---|---|---|---|
| Invention | 46 | 10 | 0.5 | 0.4 |
| Comparative | 10 | 10 | 1.4 | 0.9 |

TABLE 4

| | La (m) | Number of Strip Rolled | Magnitude of Necking (mm) | Magnitude of Hunting (mm) |
|---|---|---|---|---|
| Invention | 46 | 10 | 0.7 | 0.5 |
| Comparative | 10 | 10 | 0.9 | 0.6 |

What is claimed is:

1. A method for suppressing fluctuation of width of a hot rolled strip transferred through a path extending from a finishing mill to a coiler in a hot rolling line comprising the steps of:

maintaining the temperature of said hot rolled strip at an outlet of a finishing roll at a temperature slightly above the $Ar_3$ transformation temperature;

air cooling said hot rolled strip while it travels through said path, continuing said air cooling to bring said hot rolled strip to a temperature below an $Ar_3$ transformation starting point, and continuing said air cooling to bring the temperature of said hot rolled strip below an $Ar_3$ transformation end point of said strip; and applying a liquid state cooling medium to said hot rolled strip after the temperature of the hot rolled strip has dropped to a value below said $Ar_3$ transformation end point.

2. A method as set forth in claim 1, which further comprises the steps of:

monitoring the temperature of said hot rolled strip at the outlet of said finishing roll for generating initial strip temperature data;

predetermining the $Ar_3$ transformation point of the strip;

deriving the location of said transformation end point; and terminating air cooling and starting cooling by applying said liquid state cooling medium at the location of said transformation end point.

3. A method as set forth in claim 2, wherein said switching location is determined as a distance La downstream of the outlet of said finishing mill from the equation:

$$La = \{(\theta_F - \theta_T) \times \gamma \times \beta \times T + H_T \times \gamma \times T\}/(\alpha_A \times \theta_T) \times 6 \times 10^{-2} \times V \quad (1)$$

wherein $\theta_F$ is the temperature of the hot rolled strip at the outlet of the finishing mill (°C.);

$\theta_T$ is the temperature at the transformation end point of the strip (°C.);

$\gamma$ is the density of the steel (Kg/m$^3$);

$\beta$ is the relative temperature (kcal/kg °C.);

T is the thickness of the strip (mm);

$H_T$ is the latent heat of transformation (kcal/kg);

$\alpha_A$ is the heat transfer coefficient in air cooling (Kcal/m$^2$ hr °C.); and V is the line speed of the strip (m/min).

4. A method as set forth in claim 1, which further comprises the steps of:

providing a plurality of nozzles for discharging said liquid state cooling medium along said path;

connecting said nozzles to a cooling medium source via flow control valves and;

controlling said flow control valves in such a manner that the flow control valves associated with nozzles oriented upstream of said transformation end point are shut-off and the flow control valves associated with nozzles oriented downstream of said transformation end point are open.

5. A method as set forth in claim 4, which further comprises the steps of:

monitoring the temperature of said hot rolled strip at the outlet of said finishing roll for generating initial strip temperature data;

predetermining the $Ar_3$ transformation point of the strip;

deriving the location of said transformation end point; and terminating air cooling and starting cooling by said liquid state cooling medium at the location of said transformation end point.

6. A method as set forth in claim 5, wherein said switching location is determined as a distance La downstream of the outlet of said finishing mill from the equation:

$$La = \{(\theta_F - \theta_T) \times \gamma \times \beta \times T + H_T \times \gamma \times T\}/(\alpha_A \times \theta_T) \times 6 \times 10^{-2} \times V \quad (1)$$

wherein $\theta_F$ is the temperature of the hot rolled strip at the outlet of the finishing mill (°C.);

$\theta_T$ is the temperature at the transformation end point of the strip (°C.);

$\gamma$ is the density of the steel (Kg/m$^3$);

$\beta$ is the relative temperature (kcal/kg °C.);

T is the thickness of the strip (mm);

$H_T$ is the latent heat of transformation (kcal/kg);

$\alpha_A$ is the heat transfer coefficient in air cooling (Kcal/m$^2$ hr °C.); and V is the line speed of the strip (m/min).

7. A method as set forth in claim 1, which further comprises sensing and monitoring the condition of said hot rolled strip and detecting the location of its transformation end point and switching said cooling mode from said air cooling to cooling by said liquid state cooling medium.

* * * * *